US008905484B2

(12) United States Patent
Kim

(10) Patent No.: US 8,905,484 B2
(45) Date of Patent: Dec. 9, 2014

(54) FUNCTIONAL CHAIR FOR PUTTING ON SHOES

(76) Inventor: Hyong-Taek Kim, Seoul (KR)

( * ) Notice: Subject to any disclaimer, the term of this patent is extended or adjusted under 35 U.S.C. 154(b) by 0 days.

(21) Appl. No.: 13/991,481

(22) PCT Filed: Dec. 8, 2010

(86) PCT No.: PCT/KR2010/008748

§ 371 (c)(1),
(2), (4) Date: Jun. 4, 2013

(87) PCT Pub. No.: WO2012/077835

PCT Pub. Date: Jun. 14, 2012

(65) Prior Publication Data

US 2013/0249260 A1 Sep. 26, 2013

(30) Foreign Application Priority Data

Dec. 6, 2010 (KR) ..... 20-2010-0012562 U

(51) Int. Cl.

| | |
|---|---|
| ***A47B 85/00*** | (2006.01) |
| ***A47C 1/00*** | (2006.01) |
| ***A47C 7/62*** | (2006.01) |
| ***A47C 9/00*** | (2006.01) |
| ***A47C 15/00*** | (2006.01) |

(52) U.S. Cl.

CPC ... *A47C 1/00* (2013.01); *A47C 7/62* (2013.01); *A47C 9/00* (2013.01); *A47C 15/004* (2013.01)

USPC ..... 297/423.21; 297/188.11; 108/25

(58) Field of Classification Search

CPC ..... A47B 7/02; A47B 3/00; A47B 3/14; A47C 1/08; A47C 16/02; A47C 7/62

USPC ..... 297/188.11, 239, 236, 237, 423.14, 297/423.41; 108/25, 26, 50.01, 91, 92, 93

See application file for complete search history.

(56) References Cited

U.S. PATENT DOCUMENTS

| | | | | | |
|---|---|---|---|---|---|
| 1,330,373 | A * | 2/1920 | Hall | 297/188.08 |
| 1,505,829 | A * | 8/1924 | Warnecke | 297/423.21 |
| 1,767,708 | A * | 6/1930 | Simpson | 297/423.14 |
| 3,230,006 | A * | 1/1966 | Sokolis | 297/188.11 |
| 4,972,781 | A * | 11/1990 | Montgomery et al. | 108/25 |
| D345,865 | S * | 4/1994 | Tintori | D6/336 |
| 5,357,873 | A * | 10/1994 | Hilton | 108/92 |
| 5,524,957 | A * | 6/1996 | Gibriano | 297/188.11 |
| D401,790 | S * | 12/1998 | Buell | D6/484 |
| 6,145,931 | A * | 11/2000 | Subotic | 297/188.11 |
| D447,891 | S * | 9/2001 | Wood et al. | D6/480 |
| 6,398,326 | B1 * | 6/2002 | Wang | 108/50.01 |
| 6,648,430 | B2 * | 11/2003 | Rohde et al. | 312/301 |
| D490,261 | S * | 5/2004 | Astle et al. | D6/511 |
| 6,969,119 | B1 * | 11/2005 | Jennings | 297/423.41 |
| 6,997,111 | B2 * | 2/2006 | Giegerich | 108/25 |
| 7,354,110 | B1 * | 4/2008 | Raghubir | 297/423.45 |
| 7,891,306 | B2 * | 2/2011 | Yamashita | 108/93 |
| 7,966,947 | B2 * | 6/2011 | Roleder | 297/423.41 |
| 8,333,160 | B2 * | 12/2012 | Lin | 108/25 |
| 2005/0248192 | A1 * | 11/2005 | Schaller | 297/239 |

* cited by examiner

FOREIGN PATENT DOCUMENTS

| | | | |
|---|---|---|---|
| JP | 2000236989 | A | 9/2000 |
| JP | 2003210280 | A | 7/2003 |
| KR | 1020100095675 | A | 9/2010 |
| KR | 200451100 | Y1 | 11/2010 |

*Primary Examiner* — Jose V Chen

(74) *Attorney, Agent, or Firm* — AKC Patents, LLC; Aliki K. Collins

(57) ABSTRACT

A functional chair is capable of storing articles such as shoes, shoe brushes, umbrellas, canes and the like by utilizing a narrow space effectively, and can be used as a chair for senior citizens and for children to sit and put on shoes.

2 Claims, 5 Drawing Sheets

FUNCTIONAL CHAIR FOR PUTTING ON SHOES

CROSS-REFERENCE TO RELATED APPLICATION

This application claims the benefit of Korean Patent Application No. 20-2010-0012562, filed on Dec. 6, 2010 in the Korean Intellectual Property Office, the disclosure of which is incorporated herein by reference.

TECHNICAL FIELD

The present invention relates to a functional chair which is used when wearing shoes.

BACKGROUND ART

The present invention is directed to a functional chair which is used when wearing shoes. When putting on or off shoes in the conventional art, a person puts on or off standing at an entrance. It is hard for a disabled person or an old or infirm person to put on or off shoes while keeping a standing posture, so such persons generally put on or off shoes in squatting postures at the entrance. In special cases, the persons put on or off shoes sitting in a prepared chair which does not have an armrest or a backrest at the entrance. Since such chairs are not originally designed for persons to put on or off shoes sitting in the chairs, the heights of the chairs are not proper for persons to put on or off shoes sitting in the chairs. In most of cases, such chairs are generally used at the entrance, so the entrance becomes complicated. In particular, the entrance is designed to store various items such as an umbrella, a cane, a shoes brush, balls, a baby carriage, etc., so the entrance becomes more complicated, which makes it hard to store the chair. For the above mentioned reasons, in almost cases, persons usually put on or off shoes in squatting postures at the entrance.

DISCLOSURE OF INVENTION

Accordingly, the present invention is made so as to resolve the above mentioned problems. It is an object of the present invention to provide a functional chair for putting on shoes which makes it possible to efficiently use the space at normal time in such a way to provide an old or infirm person or children with a help when putting shoes.

To achieve the above objects, there is provided a functional chair for putting on shoes, comprising an upper plate in which a user can sit in all directions; a lower plate which is coupled to an end portion of a column disposed below the upper plate, wherein the lower plate is configured in such a way that a thing can be disposed in a space formed between the lower plate and the upper plate; at least one column which is provided below the lower plate, the column being able to be uprightly installed on the ground;

at least one selected from between a drawer and a stand which is built-in at a side surface of the upper plate and which comes out when in use for thereby storing various items such as a shoes polish, a shoes brush, a cane and an umbrella; and an assistant support which is provided in the functional chair for a kid to sit in or to place his feet thereon when putting on shoes.

The assistant support is a support which is separate from the functional chair and is stored in a space below the lower plate and is withdrawn out when in use.

The assistant support has features in that an assistant flat plate is placed above the lower plate, and at an end portion of the assistant flat plate is provided a closed member, so the assistant flat plate does not depart outwards of the lower plate, and below the assistant flat plate is provided a column for thereby supporting the assistant flat plate when a user sits in the assistant flat plate or places feet thereon.

A lower plate stand is provided at a side surface of the lower plate for thereby storing a cane or an umbrella and is configured to fix the cane when a user gets to his feet with the aid of the cane.

Advantageous Effects

The present invention provides a functional chair which provides an effect of obtaining a space which helps children, an old and infirm person and disabled person easily put on shoes and in which to store various items.

Figure 1:
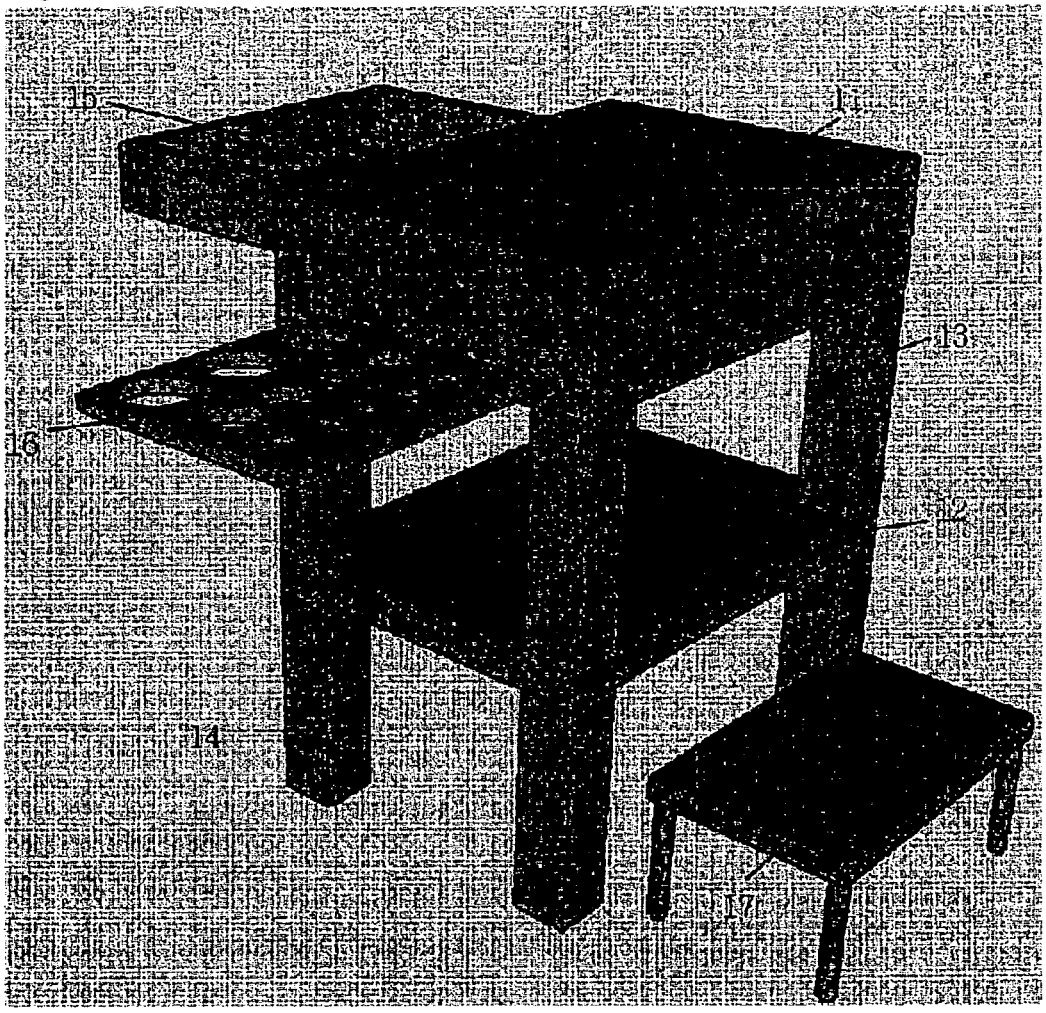
FIGS. 1 and 2 are views illustrating an embodiment of the present invention.

| <Legend of Reference Numerals> | |
|---|---|
| 11: upper plate | 12: lower plate |
| 13, 14: column | 15: drawer |
| 16: stand | 17: assistant support |
| 16: lower plate stand | 21: assistant flat plate |
| 22: closed member | 23: assistant column |
| 24: stand opening | |

BEST MODES FOR CARRYING OUT THE INVENTION

Figure 2:
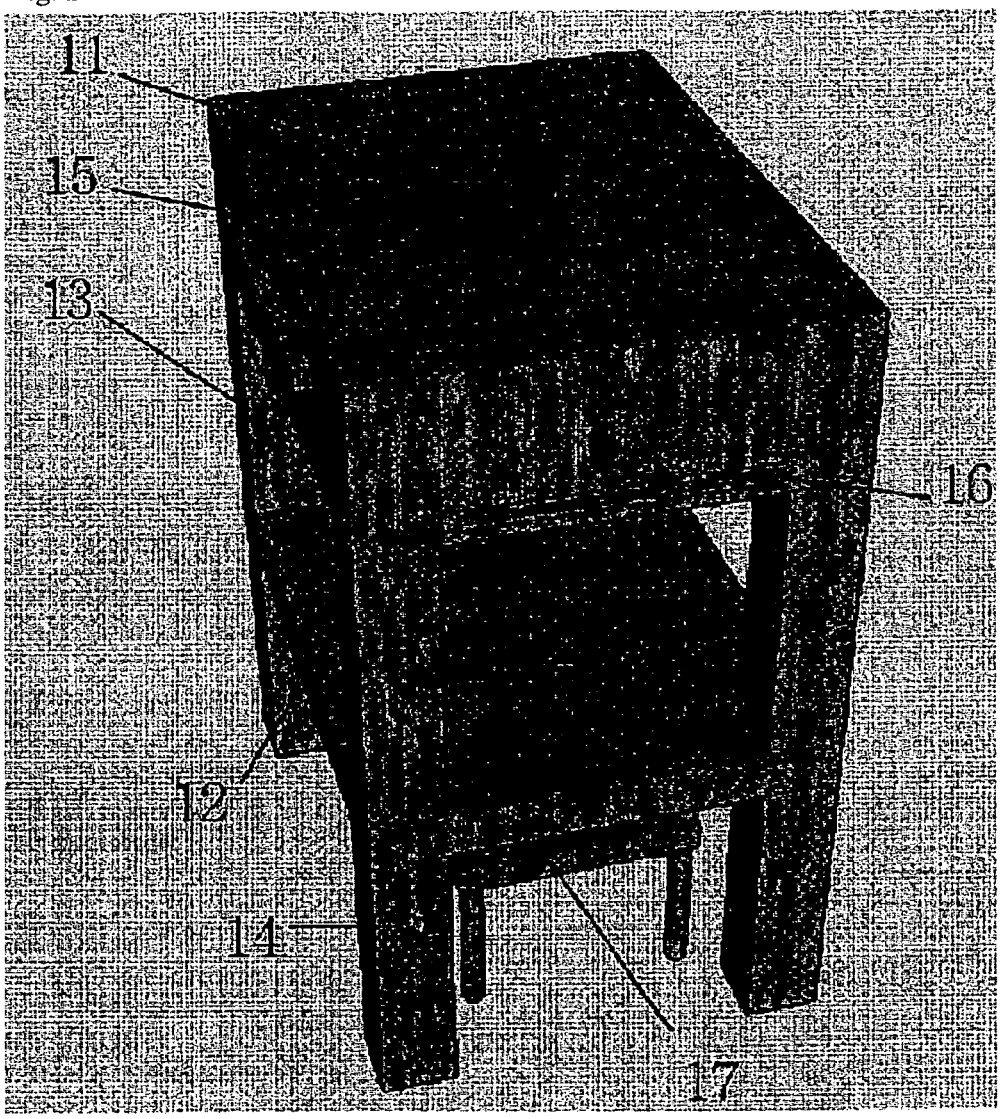

The present invention will be described hereinafter with reference to the accompanying drawings. FIG. 1 is a view illustrating a functional chair according to an embodiment of the present invention. As shown in FIG. 1, it shows a state that a drawer and an umbrella stand are exploded. Under a main body is stored an assistant chair 17. FIG. 2 is a view illustrating a state that a drawer is closed for the sake of storage when not in use.

The functional chair according to the present invention is formed in a two-floor structure as shown in FIG. 1. In the main body are provided an upper plate 11 and a lower plate 12 both of which are formed in flat shapes. Below the upper plate and the lower plate are provided columns 13 and 14. An end portion of the column 13 disposed below the upper plate 11 is fixed at an upper surface of the lower plate 12, and the column 14 disposed below the lower plate 12 is placed on the ground.

Figure 3:
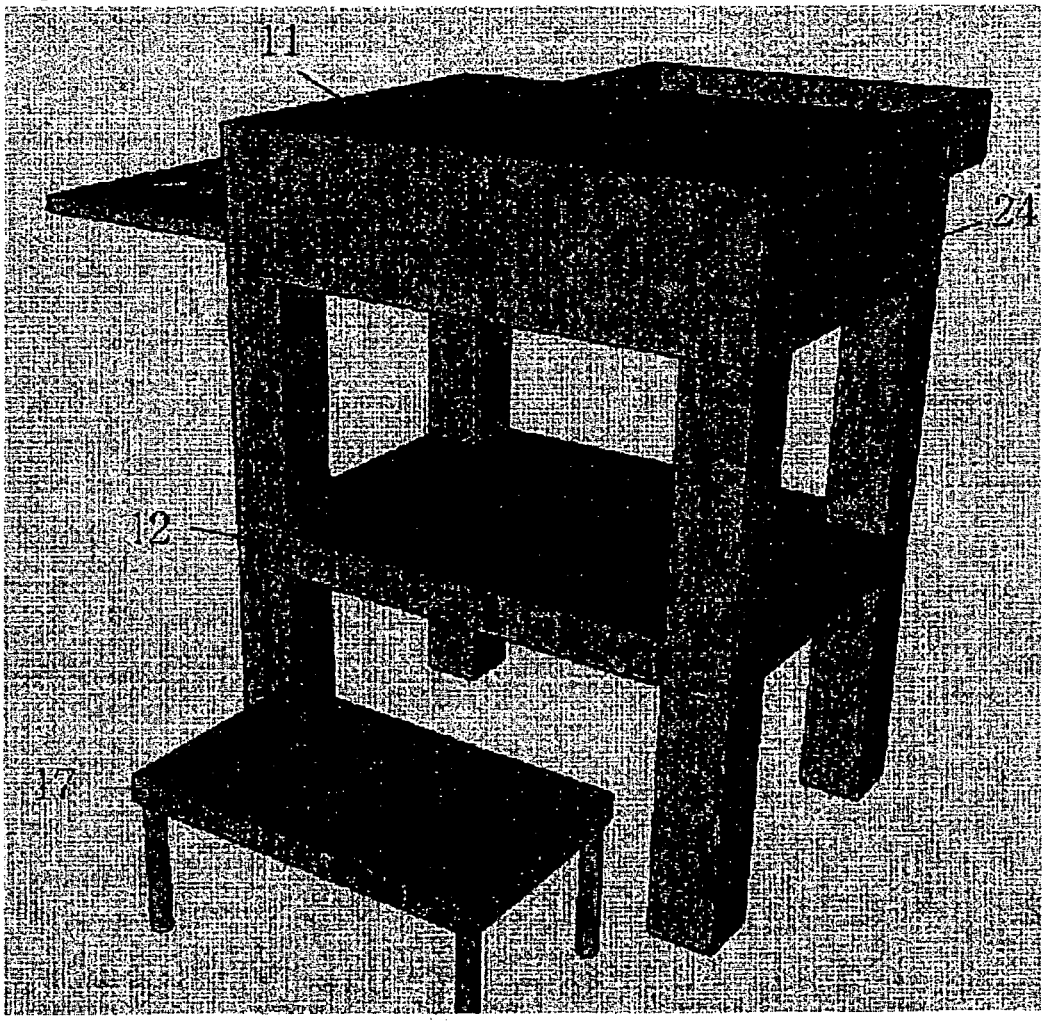
FIGS. 3, 4 and 5 are views illustrating another embodiment of the present invention.

A space is formed between the upper plate and the lower plate, and between the lower plate and the ground. In the space are stored the assistant support, the assistant chair 17 or shoes. At a side surface of the upper plate is provided a drawer 15 and a stand 16. The surfaces where the drawer 15 and the stand 16 are different from each other, and both the drawer 15 and the stand 16 can be accommodated if the upper plate 11 is sufficiently thick. The stand can come in and go out through one side surface and can go out through the other side surface when it is pushed in. In other words, as shown in FIG. 3, a stand opening 24 is formed at the side surface opposite to where the stand 16 is provided for the stand to go out. With the above mentioned constructions, the present invention makes it possible to push in or pull out the stand in either side when using the items of the present invention, so the present invention has features in that there are not any limits in terms of the directions of use when using the items of the present invention.

In addition, the drawer is configured to store various items such as a shoes brush, a shoes polish, etc., and the stand 16 has a plurality of holes into each of which is inserted an umbrella, a cane, etc. for the sake of storage, the holes being sized depending on the sizes of the inserted items. The sizes and the number of the holes formed in the stand may freely vary depending on the purposes of uses.

Shoes may be stored in the space formed between the upper plate and the lower plate, and between the lower plate and the ground can be stored the assistant support 17 in addition to the shoes. Here, the assistant support 17 is usually stored in the space between the lower plate and the ground and is used when a user puts on shoes. When in use, it can be used in such a way that the user sitting in the upper plate places one foot on the assistant support 17 or a kid can put on shoes sitting thereon. Namely, it can be used for both the adults and the kids to put on their shoes and it can be even used in a narrow space.

With the above mentioned support, it is possible to efficiently store at one side of the entrance the items such as shoes, a shoes brush, a shoes polish, an umbrella, a cane, etc. in the smaller space. For the sake of storages, it needs just a narrow space. In addition, when an old and infirm person, a disabled person, and a kid put on their shoes, they can put on shoes in sitting postures, and a person using a cane can get to his feet with the cane being inserted in the stand, which make it possible to use the present invention for multiple purposes.

Figure 4:
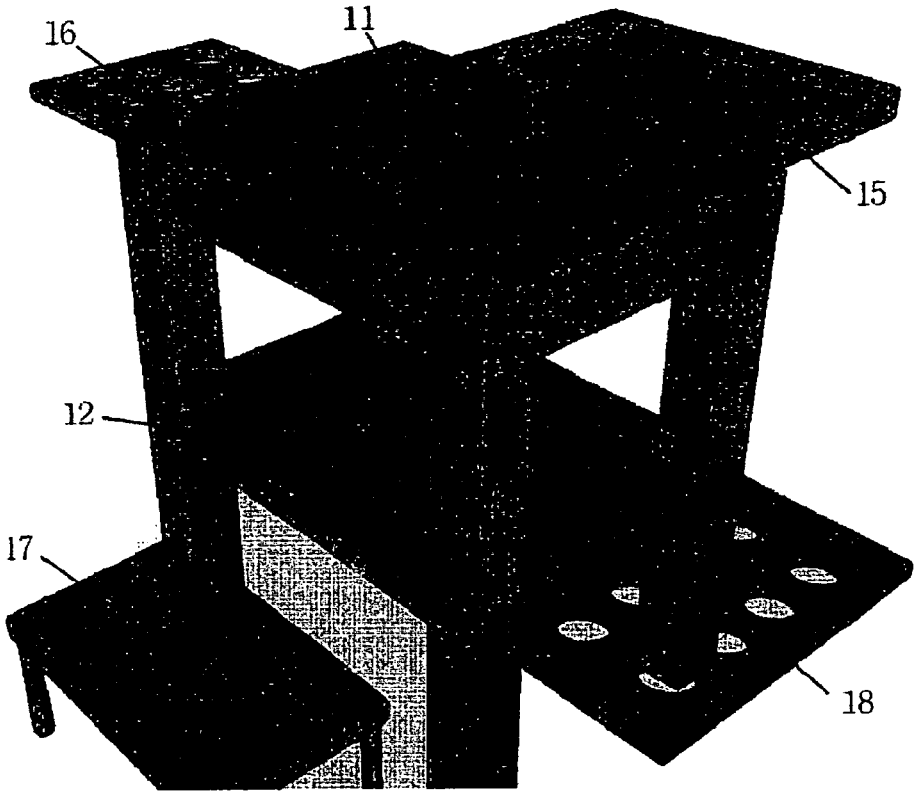

FIG. 4 is a view illustrating a construction that another stand is provided at the lower plate for the above mentioned purposes. The stand 18 of the lower plate as shown in FIG. 4 is provided at the side of the lower plate, so it can be used when inserting an umbrella, a cane, etc. or it can be used for the purpose of fixing a cane when a user gets to his feet from the sitting posture. At this time, the thicknesses of the upper plate and the lower plate and the positions and number of the stands can vary depending on the demands. The stands can be provided in multiple numbers if the thickness of the upper plate or the lower plate is set to be available.

Figure 5:
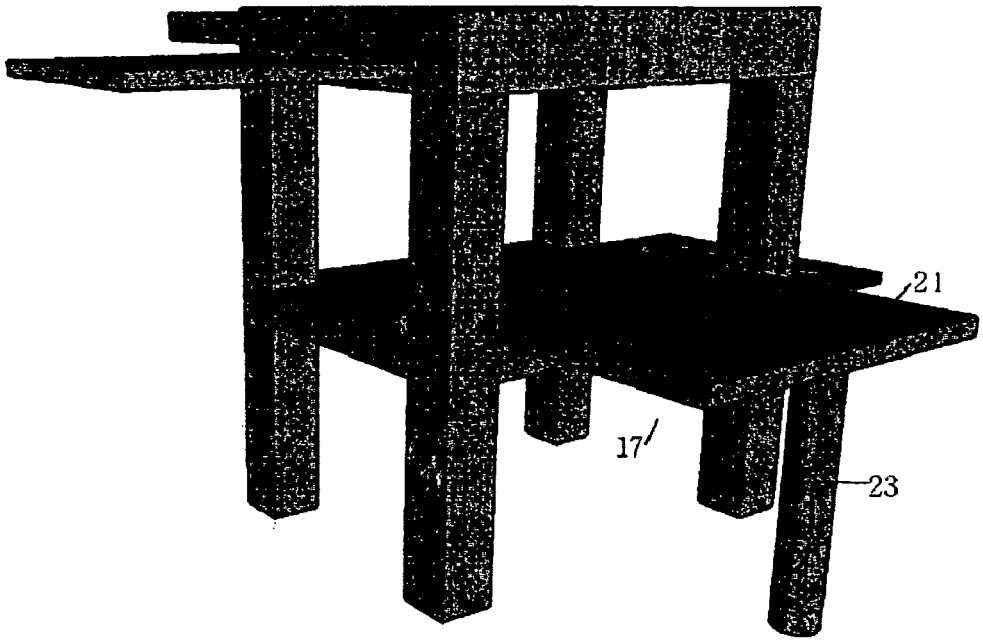

FIG. 5 is a view of another embodiment of the present invention. According to the embodiment of FIG. 5, in the assistant support 17, an assistant flat plate 21 is placed above the lower plate, and at an end portion is disposed a closed member 22, so the assistant flat plate 21 does not depart from the lower plate. In addition, the assistant column 23 is provided below the assistant flat plate 21 for thereby supporting the assistant flat plate. At the normal time, the shoes can be stored in the assistant flat plate, and the user can put on the shoes on the assistant flat plate after it is pulled and withdrawn. If the assistant flat plate is continuously used in the withdrawn state, the assistant flat plate 21 can be also used for the user to place feet on or to sit in. A certain device may be provided for the assistant flat plate 21 to smoothly slide along the lower plate, but it is known art, so the detailed descriptions thereof will be omitted.

The main body according to the present invention may be formed in a two-floor structure of an upper plate and a lower plate; however multiple upper plates and lower plates may be provided in a three-floor structure or a four-floor structure. In this case, it needs to form a space between the flat plates in which to store shoes or other things and it needs to have a certain height for the persons to sit in.

The shapes of the columns or the positions of the drawers and the stands may vary depending on the demands. The scopes of the present invention are not limited to the disclosures herein.

The invention claimed is:

1. A functional chair for putting on shoes, comprising:

an upper plate in which a user can sit in all directions;

a lower plate which is coupled to an end portion of a column disposed below the upper plate, wherein the lower plate is configured in such a way that a thing can be disposed in a space formed between the lower plate and the upper plate;

at least one column which is provided below the lower plate, the column being able to be uprightly installed on the ground;

at least one selected from between a drawer and a stand which is built-in at a side surface of the upper plate and which comes out when in use for thereby storing various items such as a shoes polish, a shoes brush, a cane and an umbrella;

an assistant support which is provided in the functional chair for a kid to sit in or to place his feet thereon when putting on shoes;

wherein the assistant support is a support which is separate from the functional chair and is stored in a space below the lower plate and is withdrawn out when in use;

wherein a lower plate stand is provided at a side surface of the lower plate for storing a cane or an umbrella and wherein the lower plate is configured to fix the cane when a user gets to his feet with the aid of the cane.

2. A functional chair for putting on shoes, comprising:

an upper plate in which a user can sit in all directions;

a lower plate which is coupled to an end portion of a column disposed below the upper plate, wherein the lower plate is configured in such a way that a thing can be disposed in a space formed between the lower plate and the upper plate;

at least one column which is provided below the lower plate, the column being able to be uprightly installed the ground;

at least one selected from between a drawer and a stand which is built-in at a side surface of the upper plate and which comes out when in use for thereby storing various items such as a shoes polish, a shoes brush, a cane and an umbrella;

an assistant support which is provided in the functional chair for a kid to sit in or to place his feet thereon when putting on shoes;

wherein the assistant support has features in that an assistant flat plate is placed above the lower plate, and at an end portion of the assistant flat plate is provided a closed member, so the assistant flat plate does not depart outwards of the lower plate, and below the assistant flat plate is provided a column for thereby supporting the assistant flat plate when a user sits in the assistant flat plate or places feet thereon; and wherein a lower plate stand is provided at a side surface of the lower plate for storing a cane or an umbrella and wherein the lower plate is configured to fix the cane when a user gets to his feet with the aid of the cane.

* * * * *